US005200985A

United States Patent [19]

Miller

[11] Patent Number: 5,200,985

[45] Date of Patent: Apr. 6, 1993

[54] X-RAY TUBE WITH CAPACITIVELY COUPLED FILAMENT DRIVE

[75] Inventor: Lester Miller, Forest Park, Ill.

[73] Assignee: Picker International, Inc., Highland Hts., Ohio

[21] Appl. No.: 817,295

[22] Filed: Jan. 6, 1992

[51] Int. Cl.[5] ..... H01J 35/06

[52] U.S. Cl. ..... 378/135; 378/101; 378/134; 378/136

[58] Field of Search ..... 378/91, 101, 102, 103, 378/106, 107, 119, 121, 132, 134, 135, 136

[56] References Cited

U.S. PATENT DOCUMENTS

| | | | |
|---|---|---|---|
| 2,111,412 | 3/1938 | Ungelenk | 250/35 |
| 3,852,605 | 12/1974 | Watanabe et al. | 250/401 |
| 4,045,672 | 8/1977 | Watanabe | 250/360 |
| 4,199,684 | 4/1980 | Leunbach et al. | 250/402 |
| 4,206,356 | 6/1980 | Wardley et al. | 250/402 |
| 4,250,425 | 2/1981 | Gabbay et al. | 313/60 |
| 4,417,171 | 11/1983 | Schmitmann | 378/132 |
| 4,521,900 | 6/1985 | Rand | 378/137 |
| 4,769,831 | 9/1988 | Broenner | 378/144 |
| 4,788,705 | 11/1988 | Anderson | 378/121 |
| 4,869,257 | 9/1989 | Molnar et al. | 128/660.1 |
| 4,878,235 | 10/1989 | Anderson | 378/136 |
| 4,914,681 | 4/1990 | Klingenbeck et al. | 378/12 |

*Primary Examiner*—David P. Porta

*Attorney, Agent, or Firm*—Fay, Sharpe, Beall, Fagan, Minnich & McKee

[57] ABSTRACT

A cathode assembly (B) including cathode filaments (52, 54) remain stationary in the interior of a rotating evacuated envelope (C). The cathode filaments generate a beam of electrons (12) which strike an annular anode surface (10) that rotates with the envelope to generate a beam of x-rays (14). Electrical power from an AC electrical source (62) is conveyed across a circularly cylindrical peripheral side wall (20) of the envelope by pairs of concentric capacitive ring members (64, 70); (66, 72). One of the cathode filaments is selected either with (i) reed switches (82, 84), (ii) by bringing a selected one of the filaments and the capacitor rings into resonance at the frequency of the AC electrical source with a switch (86) and inductance (**88*a*, 88*b*), or (iii) with a third pair of annular capacitive members (100, 102**).

21 Claims, 2 Drawing Sheets

X-RAY TUBE WITH CAPACITIVELY COUPLED FILAMENT DRIVE

BACKGROUND OF THE INVENTION

The present invention relates to the x-ray tube art. It finds particular application in conjunction with high power x-ray tubes for use with CT scanners and the like and will be described with particular reference thereto. It will be appreciated, however, that the invention will also have other applications.

Typically, a high power x-ray tube includes a cathode filament through which a current of about 5 amps is passed at a voltage sufficient to provide about 75 watts of power. This current heats the filament sufficiently that it is caused to emit a cloud of electrons, i.e. thermionic emission. A high potential on the order of 100 kV is applied between the cathode and the anode. This potential causes the electrons to flow between the cathode and the anode through the evacuated region in the interior of the envelope. Generally, this electron beam or current is on the order of 10–500 mA. The electron beam impinges on the anode generating x-rays and producing extreme heating as a byproduct. In high energy x-ray tubes, the anode is rotated at high speeds such that the electron beam does not dwell on only a small area of the anode causing thermal deformation. Each spot on the anode which is heated by the electron beam cools substantially during one rotation of the anode before it is again heated by the electron beam. Larger diameter anodes have a larger circumference, hence provide greater thermal loading. In most conventional rotating anode x-ray tubes, the envelope and the cathode remain stationary while the anode rotates inside the envelope. The anodes dissipate heat by thermal radiation across the evacuated interior of the envelope. As more energy is put into the anode of larger tubes to produce more x-rays, the inefficiency of thermal radiation limits cooling, hence x-ray production.

In order to avoid this heat transfer difficulty, high power x-ray tubes have been proposed in which the anode and vacuum envelope rotate, while the cathode filament inside the envelope remains stationary. This configuration permits a heat transfer fluid to be circulated in direct contact with the anode to remove heat more efficiently. See for example, U.S. Pat. Nos. 4,788,705 and 4,878,235. One of the difficulties with this configuration is providing electrical energy to the stationary cathode within the rotating vacuum envelope. Conveying 5 amps of power into an evacuated envelope without degrading the vacuum can be achieved by using an air core coil or an air core transformer as illustrated by the above-referenced patents. One drawback of the air core coil or transformer configurations is that the filament current cannot be measured directly. Only the primary current of the transformer can be measured and the primary current is a complex function of core temperature, flux density, air gap length, and the like. Second, any vibration of the cathode structure induces changes in the magnetic flux linking the external primary and the internal secondary. These vibration induced changes in the flux linkage cause corresponding variations in the filament current, leading to erratic filament emission. A third drawback to these patents is that the air core coil or transformer operates at about 13.56 MHz which corresponds a skin depth in copper of about 0.024 mm. Because the electrical current is constrained to such a shallow skin depth, problems arise in the design of the low-resistance leads to the filament, as well as to localized hot spots on the filament itself.

The present invention provides a new and improved technique for transferring electrical power to the filament of an x-ray tube in which there is relative rotational movement between the envelope and the cathode.

SUMMARY OF THE INVENTION

In accordance with the present invention, an x-ray tube is provided in which an evacuated envelope and a filament contained therein undergo relative rotational movement. A capacitive coupling conveys electrical power from an AC source across the envelope to the filament disposed in the interior of the envelope.

In accordance with a more limited aspect of the present invention, the capacitive coupling includes annular rings disposed interior and exterior to the evacuated envelope in a capacitively coupled relationship.

In accordance with a more limited aspect of the present invention, the envelope includes a cylindrical side wall extending generally perpendicular to an anode affixed thereto for rotation therewith. The annular side wall passes between the interior and exterior capacitive coupling rings.

In accordance with another more limited aspect of the present invention, a plurality of cathode filaments are provided. A means is provided for applying current primarily to a selected one of the filaments.

In accordance with a more limited aspect of the present invention, the means for providing current to a selected one of the filaments includes an adjustable resonance circuit for establishing a resonance condition with only a selected one of the filaments. In this manner, electrical power is supplied primarily to the filament in resonance and substantially no electrical power is supplied to the filament(s) which is out of resonance.

One advantage of the present invention is that it allows direct power connections with the filament The filament current is directly measurable.

Another advantage of the present invention is that it reduces parasitic losses.

Another advantage of the present invention is that it is more compact than air core transformers, permitting a reduction in the size of the x-ray tube.

Still further advantages of the present invention will be come apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangement of steps. The drawings are only for purposes of illustrating a preferred embodiment and are not to be construed as limiting the invention.

DETAILED DESCRIPTION OF THE PREFERRED EMBODIMENTS

Figure 1:
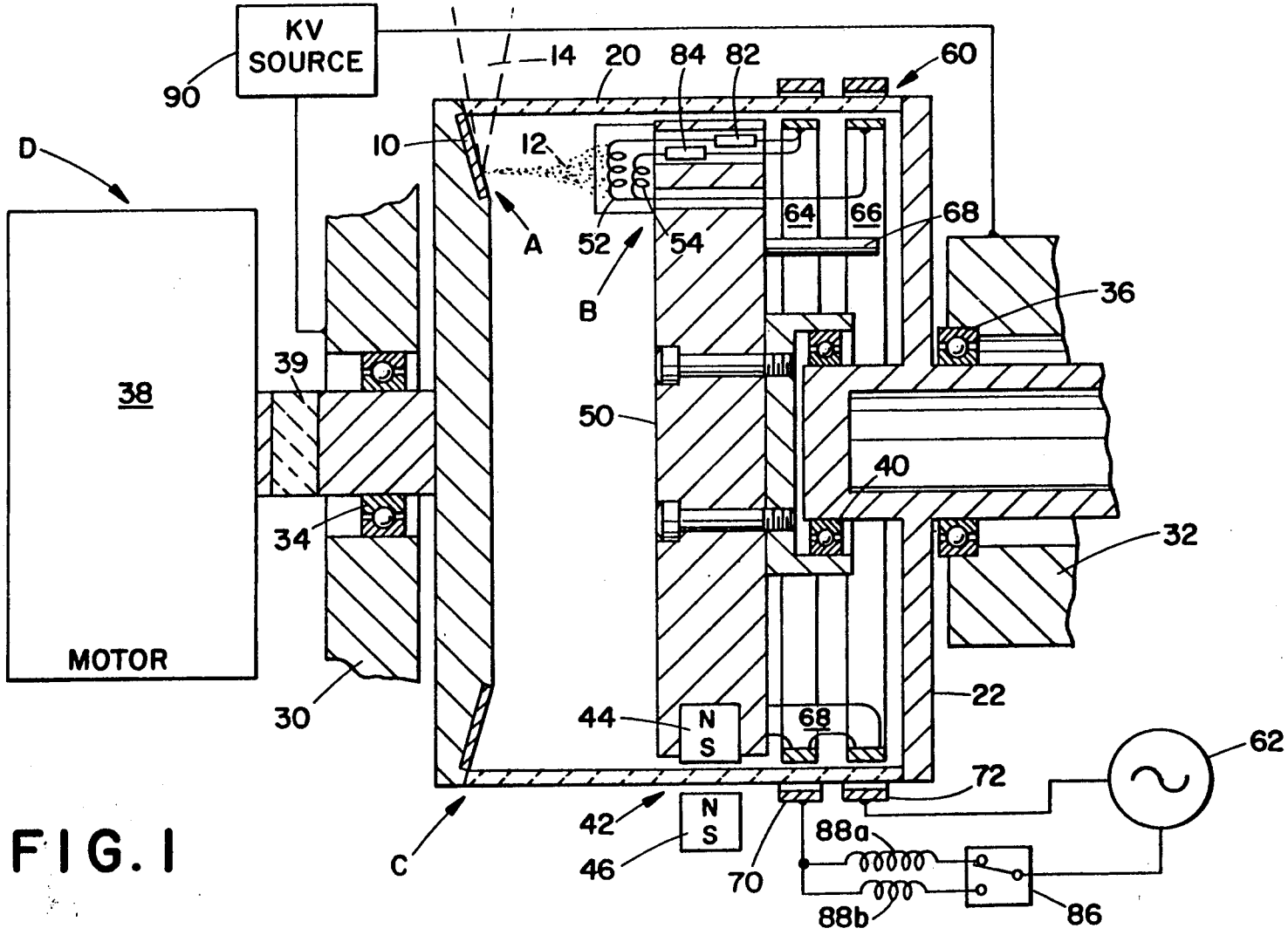
FIG. 1 is a diagrammatic illustration of an x-ray tube in accordance with the present invention.

With reference to FIG. 1, an x-ray tube includes a anode A and a cathode assembly B. An evacuated envelope C is evacuated such that an electron beam passing from the cathode to the anode passes through a vacuum.

A rotating means D enables the anode A and the envelope C to undergo rotational movement relative to the cathode assembly B.

The anode A has a beveled, annular anode surface 10 which is bombarded by an electron beam 12 from the cathode assembly B to generate a beam 14 of x-rays. The beveled, peripheral surface is constructed of tungsten, The entire anode may be machined from a single piece of tungsten. Alternatively, the beveled, peripheral anode path 10 may be an annular strip of tungsten which is connected to a highly thermally conductive disk or plate. Typically, the anode and envelope are immersed in an oil-based dielectric fluid which is circulated to a cooling means. In order to keep the face of the anode surface 10 cool, portions of the anode between the anode surface and the cooling fluid should be highly thermally conductive.

The anode A forms one end of the vacuum envelope C. A ceramic cylinder 20 is connected between the anode A and an opposite or cathode end plate 22. At least an annular portion of the cylinder 20 closely adjacent to the anode is x-ray transparent to provide a window from which the x-ray beam 14 is emitted. Preferably, the cylinder 20 is constructed at least in part of a dielectric material such that a high voltage differential can be maintained between anode A and the end plate 22. In the preferred embodiment, the end plate 22 is biased to the potential of the cathode assembly B, generally about 130 kV or more negative than the anode.

The rotation means D includes stationary mounting portions 30, 32. A first bearing 34 interconnects the first stationary portion 30 and the anode A. A second bearing 36 interconnects the second stationary portion 32 and the end plate 22. A motor 38 rotates the anode and envelope combination relative to the stationary portions 30, 32. An isolation drive coupler 39 electrically isolates the motor 38 from the anode A. A greaseless bearing 40 is mounted between the cathode assembly B and the envelope C to enable the envelope and the cathode to rotate relative to each other. A means 42 holds the cathode assembly B stationary relative to the rotating envelope C. In the preferred embodiment, the means 42 includes an array of magnets represented here by a pair of magnets 44, 46. Magnet 44 is mounted to the cathode assembly and magnet 46 is mounted to a stationary structure outside of the envelope C. The magnets are mounted with opposite poles towards each other such that the stationary magnet 46 holds magnet 44 and the cathode assembly stationary as the envelope C and the anode A rotate.

The cathode assembly B includes a cathode mounting plate 50 which is mounted on an outer race of the cathode bearing 40. The cathode plate supports a first or larger thermionic filament 52 and a second or smaller thermionic filament 54. The large and small filaments are selectively heated to produce a large or a small size focal spot of the electron beam on the anode surface. Optionally, additional coils, plates, or other electronics (not shown) may be mounted adjacent the filaments to focus the beam 12. The filaments and any focusing electronics are connected with a means 60 for communicating electrical power from an AC electrical power supply 62 exterior to the envelope C to the filaments in the evacuated interior of the envelope. In the preferred embodiment, the AC power supply 62 supplies AC power with a frequency in the range of about 2–4 MHz. This lower frequency is advantageous in that it corresponds to a skin depth of copper that is sufficiently deep that it avoids the localized heating and other problems discussed above in conjunction with the higher frequency current sources.

The capacitive coupling means 60 includes a pair of electrically conductive capacitor ring members 64, 66 which are mounted on insulating supports 68 to the cathode assembly mounting plate 50 The capacitor rings 64, 66 are circular in exterior cross section and mounted closely adjacent to the circularly cylindrical wall 20 of the envelope. A second pair of capacitor ring members 70, 72 are mounted stationarily outside of the envelope side peripheral wall 20. Optionally, a metallic band may be inserted into the envelope wall 20 between the interior and exterior capacitor rings effectively constructing a pair of capacitors in series.

It will be appreciated that the capacitive coupling means 60 is relatively insensitive to wobble. If the peripheral wall 20 becomes narrower on one side due to wobble, it widens by corresponding amount on the other side. This tends to keep the net capacitance constant. It might also be noted that the capacitance dielectric includes the vacuum inside the envelope, the envelope wall, and the dielectric oil exterior to the envelope in which the x-ray tube is commonly emersed.

A switching means selectively switches the power supply 62 to a selected one of the filaments 52, 54. The switching means includes circuits 82, 84 connected between one of the interior capacitor rings and a respective one of the filaments. In the preferred embodiment, the circuits 82, 84 are reactive components which cause each of the filaments in combination with the capacitive power coupling means 60 to have distinctly different resonance frequencies. Alternatively, the circuits 82, 84 may include reed switches which are selectively opened and closed by a magnet positioned externally of the envelope.

An adjustable reactance including a switch 86 an inductors **88*a*, 88*b* adjusts the reactance seen by the AC source 62. The inductors 88*a*, 88*b* are sized such that the capacitive coupling means 60, the selected one of filaments, and reed switches or circuits 82, 84 is at resonance at the frequency of the AC source 62. In this manner, the AC source sees a purely resistive load. By using tuned circuits with relatively high Q values, a relatively low voltage high frequency power supply can be used. Moreover, when the load is adjusted such that the current path through one of the selected filament is at resonance and the current path through the other filament is well displaced from resonance at the selected current AC source frequency, then substantially all electrical power passes through the filament at resonance. By selectively switching between pre-tuned reactive circuits 88*a* and 88*b*, the operator selects whether the current path through filament 52 or 54** will be resonance. Alternately, the preferred filament is chosen by varying the power supply frequency such that the inductance in line with a particular filament is in resonance with the rest of the system.

A high voltage source 90 applies a high voltage across the anode and cathode. Typically, the high voltage is on the order of 150 kV.

Figure 2:
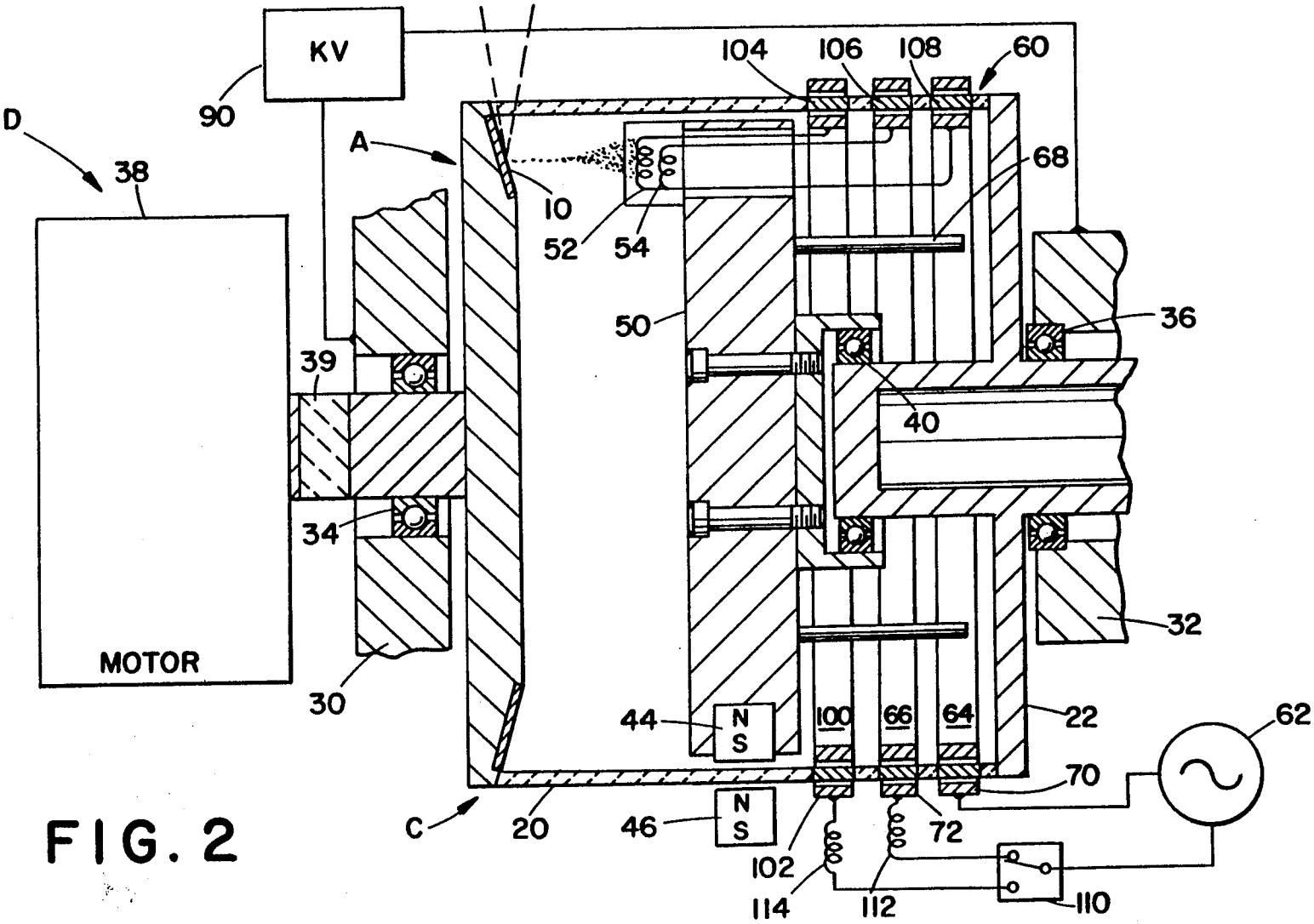
FIG. 2 is an alternate embodiment of the x-ray tube of FIG. 1.

With reference to FIG. 2, switching among a plurality of filaments can also be achieved by using additional capacitor rings. In the two filament embodiment to FIG. 2, there are three interior capacitor rings 64, 66, and 100. These are coupled with exterior capacitive rings 70, 72, and 102. Optionally, metallic rings 104, 106, and 108 are incorporated into the envelope peripheral wall 20 in order to increase the capacitance of the capacitive coupling means 60. To select between the filaments 52, 54, a switch 110 connects one side of the AC source 62 with either ring 72 or 102. Reactive circuits 112, 114 are connected between the switch and the external capacitor rings 72, 102, respectively. The reactances 112, 114 are selected such that the net inductive/-capacitive load of the filament, capacitive coupling, and the reactive circuit essentially cancels at the frequency of the AC source to present a purely resistive load to the AC source 62, regardless which filament is selected. That is, reactances 112, 114 turn the selected cathode filament circuit to resonance at the AC source frequency. Additional capacitor ring pairs may be provided to enable selection among a larger plurality of filaments, electronic focusing coils for adjusting the focus of the electron beam 12, and other electronic circuitry which may be found within the envelope C.

The invention has been described with reference to the preferred embodiments. Obviously, modifications and alternations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. In an x-ray tube which includes an evacuated envelope, a cathode assembly and an anode surface disposed within the evacuated envelope, and a means for permitting relative rotational movement between the cathode assembly and the envelope, the cathode including an electron emitting cathode filament means, THE IMPROVEMENT COMPRISING:

at least first and second annular capacitor members mounted to the cathode assembly inside of the envelope, the cathode filament means being connected between the first and second annular capacitor members to receive electrical power therefrom;

third and fourth annular capacitor members disposed exterior to the envelope, the third annular capacitor member being capacitively coupled to the first annular capacitor member and the fourth annular capacitor member being capacitively coupled to the second annular capacitor member, such that the annular capacitor members transfer AC electrical power from an external AC power source to the cathode filament means.

2. In the x-ray tube as set forth in claim 1, THE IMPROVEMENT FURTHER COMPRISING:

an adjustable reactance connected between the AC electrical source and at least one of the exterior capacitor rings for adjusting a reactance seen by the AC electrical source to be essentially purely resistive.

3. In the x-ray tube as set forth in claim 1, THE IMPROVEMENT FURTHER COMPRISING:

a second electron emitting filament means supported by the cathode assembly, the second filament means being electrically connected with the first and second interior cathode members; and a selecting means for causing electrical power from the AC electrical source to be conveyed to a selected one of the filaments means.

4. In the x-ray tube as set forth in claim 3, THE IMPROVEMENT FURTHER COMPRISING:

the selecting means including a switching means for connecting a selected one of the filaments with one of the first and second annular capacitor members.

5. In the x-ray tube as set forth in claim 3, THE IMPROVEMENT FURTHER COMPRISING:

the selecting means including an adjustable reactance means disposed between the AC power source and one of the third and fourth capacitor members for adjusting the reactance such that a circuit through the annular capacitor members and a selected one of the filament means is in resonance and an electrical circuit through the other filament means is not, such that the electrical circuit through the filament which is in resonance presents an essentially purely resistive load to the AC power source and receives substantially all supplied electrical power.

6. In the x-ray tube as set forth in claim 3, THE IMPROVEMENT FURTHER COMPRISING:

a means for adjusting a frequency of the AC electrical source such that an electrical circuit through only a selected one of the filaments is in resonance.

7. A rotating anode x-ray tube comprising:

an evacuated envelope;

an anode formed at least along an annular surface adjacent one end of the envelope;

a cathode assembly rotatably mounted within the envelope, the cathode assembly including a cathode means which undergoes thermionic emission under electrical stimulation;

a means for rotating the envelope and anode;

a means for holding the cathode assembly stationary as the envelope and anode rotate;

at least first and second capacitor members mounted to the cathode assembly, the first and second capacitor members being mounted inside of the envelope and closely adjacent thereto, the cathode means being connected with the first and second capacitor members to receive electrical stimulation therefrom;

third and fourth capacitor members mounted exterior to the envelope and closely adjacent thereto, the third capacitor member being capacitively coupled to the first capacitor member and the fourth capacitor member being capacitively coupled to the second capacitor member, such that the capacitor members transfer stimulating AC electrical power from an external AC electrical source to the cathode means.

8. The x-ray tube as set forth in claim 7 further including a means for adjusting at least one of a reactance connected between one of the exterior capacitor members and a frequency of the AC electrical source.

9. The x-ray tube as set forth in claim 7 further including:

a second cathode means supported by the cathode assembly, the second cathode means being electrically connected with the first and second interior capacitor members;

a selecting means for causing electrical power from the AC electrical source to be conveyed to a selected one of the cathode means.

10. The x-ray tube as set forth in claim 9 wherein the first and third capacitor members are concentric annular rings and wherein the second and fourth capacitor members are concentric annular rings.

11. The x-ray tube as set forth in claim 9 wherein the selecting means further includes a switching means for selectively connecting a selected one of the cathode means with one of the first and second capacitor members.

12. The x-ray tube as set forth in claim 9 wherein the selecting means further includes an adjustable reactance means disposed between the AC electrical source and one of the third and fourth capacitor members for selectively causing a circuit through the capacitor members and a selected one of the cathode means to be in resonance such that it presents and essentially purely resistive load to the AC electrical source and the other cathode means to be out of resonance, such that the in-resonance circuit receives substantially all of the supplied electrical power.

13. An x-ray tube comprising:

an evacuated envelope;

an anode formed at least along an annular surface within the envelope;

a cathode assembly rotatably mounted within the envelope;

a capacitive coupling means for providing an AC electrical communication path from an exterior of the envelope to an interior of the envelope, the capacitive coupling means being connected with the cathode assembly.

14. The x-ray tube as set forth in claim 13 wherein the capacitive coupling means includes at least two pairs of concentric annular members, each pair including an annular capacitor member disposed interior to the envelope and an annular capacitor member disposed exterior to the envelope, the interior annular capacitor members being connected with the cathode assembly.

15. The x-ray tube as set forth in claim 13 further including:

a cathode filament mounted to the cathode assembly and electrically connected with the capacitive coupling means;

a reactance adjusting means operatively connected with the capacitive coupling means for selectively adjusting a reactance of the filament, the capacitive coupling means, and the reactance adjusting means to present an essentially purely resistive reactance to an AC electrical source.

16. The x-ray tube as set forth in claim 13 further including:

a first thermionic cathode means supported by the cathode assembly;

a second thermionic cathode means supported by the cathode assembly; and, a selecting means for selectively causing electrical power from an external electrical current source connected with the capacitive coupling means to be conveyed to a selected one of the first and second thermionic cathode means.

17. The x-ray tube as set forth in claim 16 further including:

a first tuned circuit connected with the first thermionic cathode means;

a second tuned circuit connected with the second thermionic cathode means; and wherein the selecting means includes a means for adjusting a frequency of current supplied from the external current source to the capacitive coupling means.

18. The x-ray tube as set forth in claim 16 wherein the selecting means includes a switching means disposed within the envelope for selectively connecting one of the thermionic cathode means with the capacitive coupling means.

19. The x-ray tube as set forth in claim 16 wherein the selecting means includes an adjustable reactance means disposed between the capacitive coupling means and an AC electrical source, the adjustable reactance means selectively bringing a circuit formed by one of (i) the adjustable reactance means, the capacitive coupling means, and the first thermionic cathode means and (ii) the adjustable reactance means, the capacitive coupling means, and the second thermionic cathode means to resonance at a frequency of the AC electrical source such that the selected circuit presents an essentially resistive load to the AC electrical source.

20. The x-ray tube as set forth in claim 16 wherein the capacitive coupling means includes at least first, second, and third interior capacitive members mounted inside of the envelope, the first thermionic cathode means being connected with the first interior capacitor member, the second thermionic cathode means being connected with the second interior cathode member, and the first and second thermionic cathode means being connected with the third interior capacitor member, the capacitive coupling means further including first, second, and third exterior capacitor members mounted exterior and closely adjacent to the envelope, the first interior and exterior capacitive members being disposed in a capacitively coupled relationship, the second interior and exterior capacitive members being disposed in a capacitively coupled relationship, and the third interior and exterior capacitive members being disposed in a capacitively coupled relationship.

21. The x-ray tube as set forth in claim 20 wherein the interior and exterior capacitive members are pairs of concentric annular rings.

* * * * *